US009835005B2

(12) United States Patent
Krejci et al.

(10) Patent No.: US 9,835,005 B2
(45) Date of Patent: Dec. 5, 2017

(54) ENERGIZED SEAL SYSTEM AND METHOD

(71) Applicant: Cameron International Corporation, Houston, TX (US)

(72) Inventors: Michael Christopher Krejci, Houston, TX (US); Andrew Richard Hanson, Cypress, TX (US); Jay Painter, Friendswood, TX (US)

(73) Assignee: Cameron International Corporation, Houston, TX (US)

( * ) Notice: Subject to any disclaimer, the term of this patent is extended or adjusted under 35 U.S.C. 154(b) by 291 days.

(21) Appl. No.: 14/587,598

(22) Filed: Dec. 31, 2014

(65) Prior Publication Data

US 2016/0186519 A1 Jun. 30, 2016

(51) Int. Cl.
*E21B 33/04* (2006.01)
*E21B 33/03* (2006.01)

(52) U.S. Cl.
CPC ..... *E21B 33/04* (2013.01); *E21B 33/03* (2013.01)

(58) Field of Classification Search
None
See application file for complete search history.

(56) References Cited

U.S. PATENT DOCUMENTS 2,478,628 A * 8/1949 Hansen ..... E21B 33/04 220/200
3,093,996 A * 6/1963 Jones ..... E21B 33/04 73/40.5 R
3,179,398 A * 4/1965 Pepper ..... E21B 43/127 267/118
3,955,822 A * 5/1976 Irby ..... E21B 33/08 277/320
4,076,079 A * 2/1978 Herricks ..... E21B 43/26 166/308.1
4,159,637 A * 7/1979 Lamb ..... E21B 33/04 73/46
2013/0192847 A1* 8/2013 Bailey ..... E21B 33/085 166/373
2014/0060805 A1* 3/2014 Campbell ..... E21B 33/03 166/75.11

FOREIGN PATENT DOCUMENTS

EP 2357314 A2 8/2011
EP 2703599 A2 3/2014
WO 2010/129396 A2 11/2010

OTHER PUBLICATIONS

PCT International Search Report and Written Opinion; Application No. PCT/US2015/068253; dated Jun. 29, 2016; 16 pages.
PCT Notice of Invitation to Pay Additional Fees; Application No. PCT/US2015/068253; dated Mar. 29, 2016; 6 pages.

* cited by examiner

*Primary Examiner* — Shane Bomar
(74) *Attorney, Agent, or Firm* — Fletcher Yoder, P.C.

(57) ABSTRACT

Present embodiments include a sealing system configured to be disposed about a first wellhead component, wherein the sealing system includes a first seal and a pre-charging system configured to exert a first initial lateral loading force on the first seal to increase a first initial seal contact pressure of the first seal.

20 Claims, 4 Drawing Sheets

ENERGIZED SEAL SYSTEM AND METHOD

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are employed to access and extract the resource. These systems can be located onshore or offshore depending on the location of a desired resource. Further, such systems generally include a wellhead assembly that is used to extract the resource. These wellhead assemblies include a wide variety of components and/or conduits, such as various control lines, casings, valves, and the like, that are conducive to drilling and/or extraction operations. In drilling and extraction operations, in addition to wellheads, various components and tools are employed to provide for drilling, completion, and the production of mineral resources. For instance, during drilling and extraction operations seals and valves are often employed to regulate pressures and/or fluid flow.

A wellhead system often includes a tubing hanger and/or casing hanger that is disposed within the wellhead assembly and configured to secure tubing and casing suspended in the well bore. In addition, the hanger generally regulates pressures and provides a path for hydraulic control fluid, chemical injections, or the like to be passed through the wellhead and into the well bore. In such a system, various seals (e.g., annular seals) are often disposed between various components of the wellhead system, such as the tubing spool, casing spool, casing hanger, tubing hanger, pack off assembly, and so forth, to regulate and isolate pressure between such components. For example, such seals may be formed from elastomers, among other suitable materials. Unfortunately, such materials may be susceptible to degradation caused by a wide range of pressures and temperatures to which the materials are exposed within the wellhead system.

BRIEF DESCRIPTION OF THE DRAWINGS

Various features, aspects, and advantages of the present disclosure will become better understood when the following detailed description is read with reference to the accompanying figure, wherein.

DETAILED DESCRIPTION OF SPECIFIC EMBODIMENTS

Figure 1:
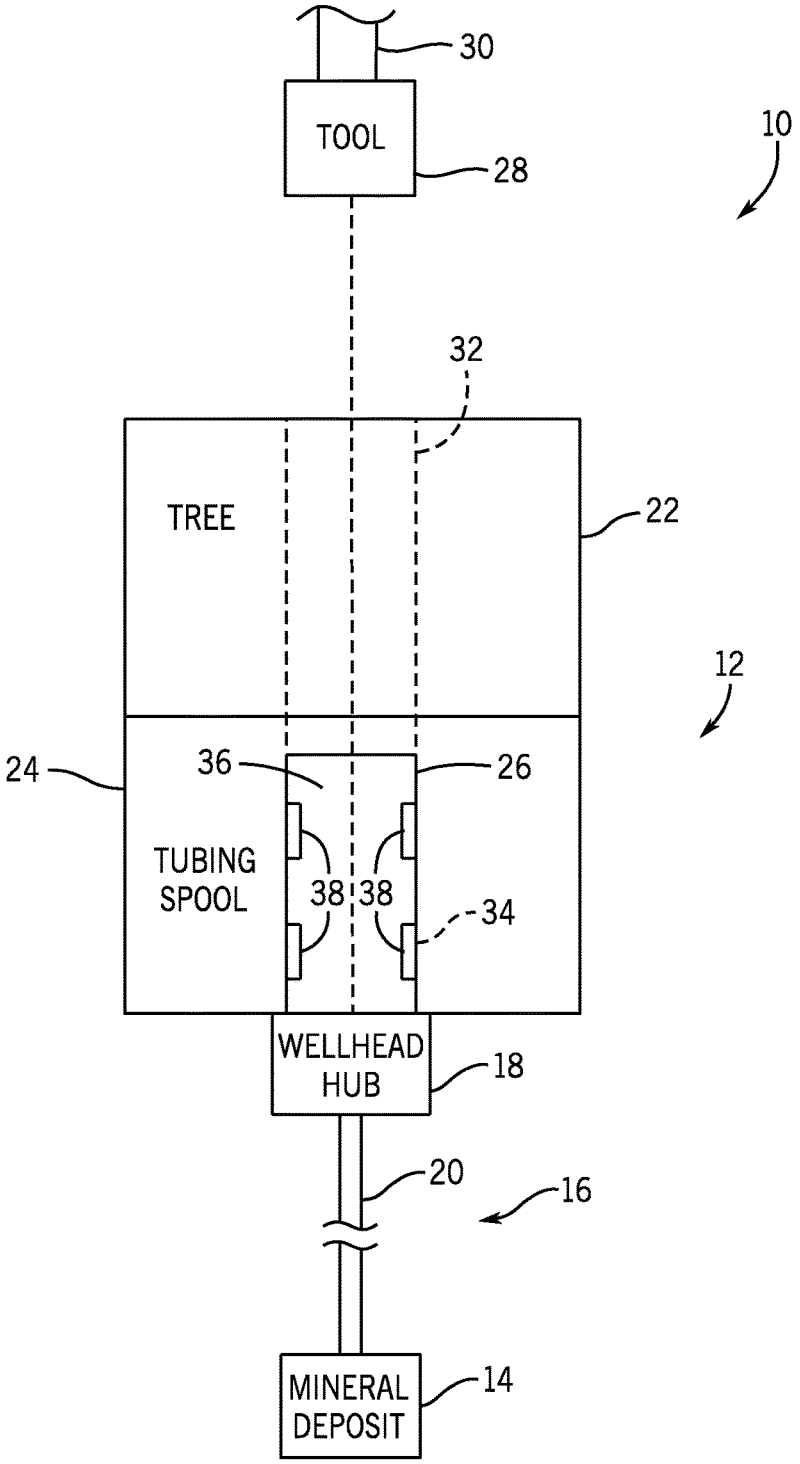
FIG. 1 is a block diagram of a mineral extraction system in accordance with embodiments of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Embodiments of the present disclosure include a system and method that addresses one or more of the above-mentioned inadequacies of conventional sealing systems and methods. As explained in greater detail below, the disclosed embodiments include sealing systems that can be installed and energized or "pre-charged" to modify the seal contact pressure of one or more seals (e.g., elastomeric seals) of the sealing system. For example, energizing seals of the sealing system may enable an increase of seal contact pressure of the seals at low temperatures. As will be appreciated, at low temperatures (e.g., below 0° C.), elastomeric seals may shrink and/or lose initial contact stress, which may decrease performance of the sealing system. That is, low temperatures may traditionally reduce the sealing capability of elastomeric seals. By energizing or pre-charging the elastomeric seals of the sealing system, the initial contact stress (e.g., seal contact pressure) may be increased initially and thereafter maintained when wellhead temperatures fall. As described in detail below, the seals of the sealing system may be energized or pre-charged via loading (e.g., lateral loading) provided by a gas, a mechanical spring, or other manner of pressurization.

Additionally, energizing or pre-charging seals of the sealing system may improve performance of the seals (e.g., elastomeric seals) at high temperatures. Specifically, at high temperatures, the seals of the sealing system may expand, and pre-charged sealing system may absorb forces exerted by the expanding seal. For example, in embodiments of the sealing system having a mechanical spring, the mechanical spring may compress as the seal expands at high temperatures, thereby reducing extrusion of the seal and controlling the seal contact pressure of the seal. Similarly, in embodiments of the sealing system where the sealing system is pre-charged with a gas (e.g., a compressible fluid), the gas may compress as the seal expands at high temperatures, thereby also reducing extrusion of the seal and controlling the seal contact pressure of the seal. Details of the sealing system and various embodiments of energizing and pre-charging the seals of the sealing system to modify seal contact pressures of the seals are described below.

FIG. 1 is a block diagram that illustrates a mineral extraction system 10. The illustrated mineral extraction system 10 can be configured to extract various minerals and natural resources, including hydrocarbons (e.g., oil and/or natural gas), or configured to inject substances into the earth. The mineral extraction system 10 may be land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20.

The wellhead hub 18 generally includes a large diameter hub that is disposed at the termination of the well bore 20. The wellhead hub 18 provides for the connection of the wellhead 12 to the well 16. For example, the wellhead 12 includes a connector that is coupled to a complementary connector of the wellhead hub 18. In one embodiment, the wellhead hub includes a complementary collet connector.

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, and provide for the injection of chemicals into the well bore 20 (down-hole). In the illustrated embodiment, the wellhead 12 includes what is colloquially referred to as a christmas tree 22 (hereinafter, a tree), a tubing spool 24 (and/or a casing spool), and a hanger 26 (e.g., a tubing hanger and/or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a retrievable running tool that is lowered (e.g., run) from an offshore vessel to the well 16 and/or the wellhead 12. In other embodiments, such as those for surface systems, the tool 28 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools (e.g., the hanger 26) into the well 16, the injection of various chemicals into the well 16 (down-hole), and the like. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities.

The tubing spool 24 provides a base for the wellhead 24 and/or an intermediate connection between the wellhead hub 18 and the tree 22. Typically, the tubing spool 24 is one of many components in a modular subsea or surface mineral extraction system 10 that is run from an offshore vessel or surface system. The tubing spool may support the tubing hanger and be mounted on a casing spool that supports a casing hanger, or the two spools may be combined into one and support one or more hangers. The tubing spool 24 includes the tubing spool bore 34. The tubing spool bore 34 connects (e.g., enables fluid communication between) the tree bore 32 and the well 16. Thus, the tubing spool bore 34 may provide access to the well bore 20 for various completion and workover procedures. For example, components can be run down to the wellhead 12 and disposed in the tubing spool bore 34 to seal-off the well bore 20, to inject chemicals down-hole, to suspend tools down-hole, to retrieve tools down-hole, and the like.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, mineral extraction systems 10 employ various mechanisms, such as seals, plugs and valves, to control and regulate the well 16. For example, seals and sealing systems are employed to isolate flow and pressures of fluids in various bores and channels throughout the mineral extraction system 10. For instance, the illustrated hanger 26 (e.g., tubing hanger and/or casing hanger) is typically disposed within the wellhead 12 to secure tubing and casing suspended in the well bore 20, and to provide a path for hydraulic control fluid, chemical injections, and the like. The hanger 26 includes a hanger bore 36 that extends through the center of the hanger 26, and that is in fluid communication with the tubing spool bore 34 and the well bore 20. As will be appreciated, pressures in the bores 20 and 34 may manifest through the wellhead 12 if not regulated and/or isolated. Sealing systems 38 may be disposed between the hanger 36 and the tubing spool 24 to isolate the pressure. In other words, the sealing systems 38 may be disposed in an annular region between the hanger 36 and the tubing spool 24. Similar sealing systems 38 may be used throughout mineral extraction systems 10 to isolate fluid pressures and flows. For example, sealing systems 38 (e.g., annular sealing systems) may be disposed about other hangers 36, pack-off assemblies, and other components of the wellhead 12 to isolate various pressures and fluid flows. The sealing systems 38 may include one or more seals, such as elastomer seals. In certain embodiments, the seals included in the sealing systems 38 may be simple elastomer seals or seals having an elastomer component along with other components. For example, a seal in the sealing system 38 may be a metal end cap seal having metal end caps disposed on opposite axial ends of an elastomer seal component.

As mentioned above, the sealing systems 38 disclosed herein may be energized and/or charged to modify a seal contact pressure of the one or more seals in the sealing system 38. In particular, the sealing system 38 (e.g., seals of the sealing system) may be installed within the wellhead 12, and the sealing system 38 (e.g., seals of the sealing system 38) may be initially energized by lateral loading. In certain embodiments, the seals of the sealing system 38 may be initially energized within the wellhead 12 by a pressurized gas. The pressurized gas may establish higher seal contact pressures of the seals against components of the wellhead 12 (e.g., the hanger 26 and the tubing spool 24). As a result, the seals of the sealing system 38 may have improved performance (e.g., more effective sealing contact) at high and/or low temperatures. In other embodiments, the one or more seals of the sealing system may be energized by a mechanical spring, such as a Bellville washer. As discussed in detail below, the mechanical spring (e.g., Bellville washer) may place an initial lateral load on the one or more seals to initially increase contact pressure of the one or more seals. At low temperatures, when the seal may shrink, the mechanical spring may expand to maintain seal contact pressure of the one or more seals against components of the wellhead 12 (e.g., the hanger 26 and the tubing spool 24). Conversely, at high temperatures, when the one or more seals may expand, the mechanical spring (e.g., Bellville washer) may compress to control the increased seal contact pressure of the one or more seals and reduce extrusion of the one or more seals within the wellhead 12.

Figure 2:
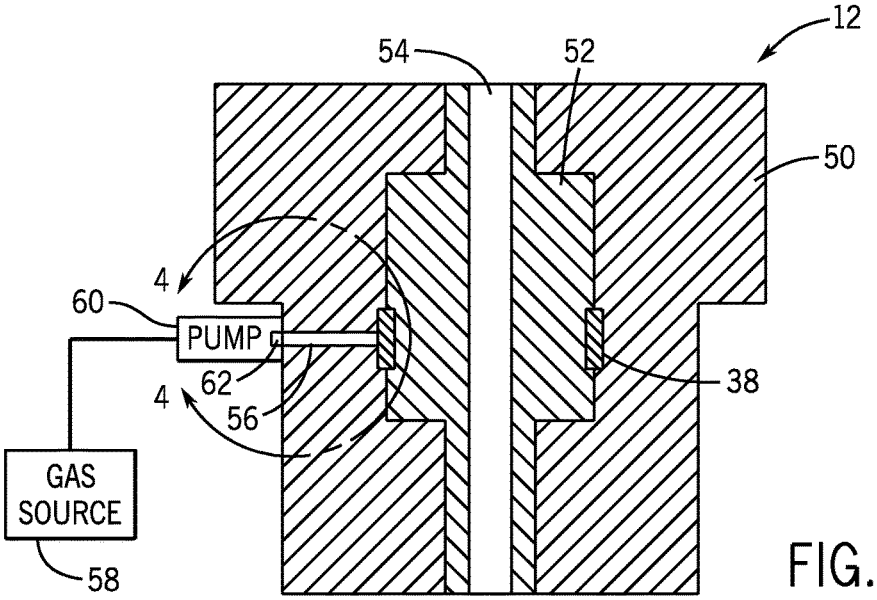
FIG. 2 is a partial schematic of a wellhead system having a sealing system, in accordance with embodiments disclosure.

FIG. 2 is a partial schematic of an embodiment of the wellhead 12, illustrating an embodiment of the sealing system 38 disposed between wellhead components. Specifically, the sealing system 38 is disposed between a tubing spool 50 (e.g., tubing spool 24) and a tubing hanger 52 (e.g., hanger 36). As similarly described above, the tubing hanger 52 is disposed within the tubing spool 50 to secure tubing suspended in the well bore 20, and to provide a path (e.g., flow path 54) for hydraulic control fluid, chemical injections, and so forth. The sealing system 38 in the illustrated embodiment is an annular sealing system disposed about the tubing hanger 52 in an annular region between the tubing hanger 52 and the tubing spool 50. The sealing system blocks flow and isolates pressure between the tubing hanger 52 and the tubing spool 50.

As mentioned above, the sealing system 38 may be energized or pre-charged via a pre-charging system to modify a seal contact pressure of one or more seals in the sealing system 38. In certain embodiments, the pre-charging system of the sealing system 38 may include one or more mechanical springs (e.g., a Belleville washer) to energize one or more seals of the sealing system 38. As described in detail below, the mechanical spring may provide initial lateral loading of the seal of the sealing system 38 and may compress and/or expand to maintain seal contact pressure of the seal during temperature fluctuations.

In other embodiments, the pre-charging system of the sealing system 38 may include a pressurized gas (e.g., a compressible fluid) supplied by a gas source and a pump. In such an embodiment, the tubing spool 50 includes an energizing port 56 configured to flow a pressurized gas to the sealing system 38. The pressurized gas may be supplied by a gas source 58 and a pump 60 that pumps the gas into the sealing system 38. As discussed in detail below, the pressurized gas within the sealing system 38 may contact the seals of the sealing system 38 and force or bias the seals against surfaces of wellhead 12 components (e.g., the tubing hanger 52 and the tubing spool 50) to increase the seal contact pressure of the seals after the sealing system 38 is installed within the wellhead 12. Additionally, as temperatures fluctuate during operation of the mineral extraction system 10, the seals may expand and/or contract. At such times, the pressurized gas may compress and/or expand to help maintain the seal contact pressure of the seals against the tubing hanger 52 and the tubing spool 52. To maintain pressure of the pressurized gas within the sealing system 38 and the energizing port 56, the tubing spool 50 may include a plug or check valve 62. As will be appreciated, for embodiments of the sealing system 38 having a mechanical spring to modify seal contact pressure, the tubing spool 50 may not include the energizing port 56, and the mineral extraction system 10 may not include the gas source 58, pump 60, or plug 62.

Figure 3:
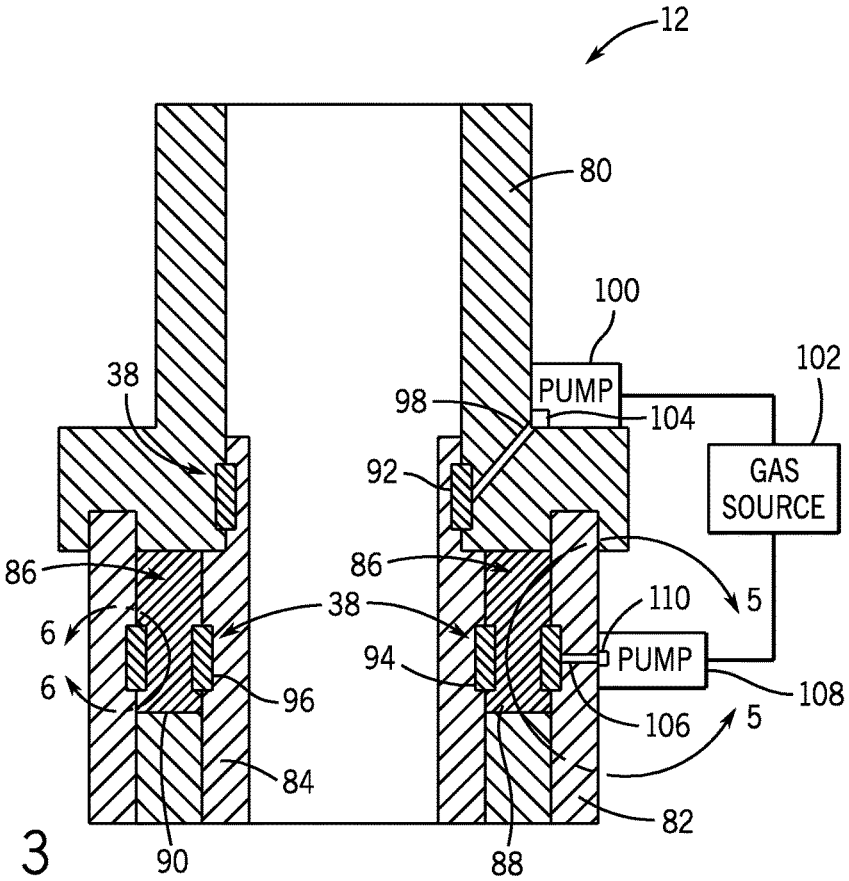
FIG. 3 is a partial schematic of a wellhead system having a sealing system, in accordance with embodiments disclosure.

FIG. 3 is a partial schematic of an embodiment of the wellhead 12, illustrating two embodiments of the sealing system 38 disposed between wellhead components. Specifically, the illustrated embodiment of the wellhead 12 includes a tubing spool 80, a casing spool 82, and a casing hanger 84 disposed within the tubing spool 80 and the casing spool 82. The wellhead 12 also includes seal pack-off assemblies 86 (e.g., a first seal pack-off assembly 88 and a second seal-pack off assembly 90). The wellhead 12 further includes three sealing systems 38, each of which may be energized or pre-charged to modify seal contact pressures of the one or more seals of each sealing system 38. A first sealing system 92 (e.g., a cross-over sealing system) is disposed between the tubing spool 80 and the casing hanger 84. A second sealing system 94 is disposed about the first pack-off assembly 88 between the casing spool 82 and the casing hanger 84, and a third sealing system 96 is disposed about the second pack-off assembly 90 between the casing spool 82 and the casing hanger 84. As will be appreciated, each of the first, second, and third sealing systems 92, 94, and 96 may have an annular configuration (e.g., annular seals). In particular, the first sealing system 92 may be annularly disposed about the casing hanger 84, while the second and third sealing systems 94 and 96 may be annularly disposed about the first and second pack-off assemblies 88 and 90, respectively.

Each of the first, second, and third sealing systems 92, 94, and 96 is energized or pre-charged to modify a seal contact pressure of the respective seals of the first, second, and third sealing systems 92, 94, and 96. For example, the first sealing system 92 is energized via a pressurized gas. As such, the tubing spool 80 includes an energizing port 98 extending through the tubing spool 80. Specifically, the energizing port 98 extends from a pump 100 to the first sealing system 92. As similarly discussed above with respect to FIG. 2, gas from a gas source 102 is pressurized by the pump 100 and supplied to the first sealing system 92. Within the first sealing system 92, the pressurized gas biases or forces seals of the first sealing system 92 against wellhead 12 components (e.g., the tubing spool 80 and the casing hanger 84) to initially increase seal contact pressure of the seals against the wellhead 12 components. The pressurized gas also expands and/or compresses as wellhead 12 temperatures fluctuate to help maintain seal contact pressure of the first sealing system 92. A plug or check valve 104 disposed at the energizing port 98 may be included to help maintain pressurization of the pressurized gas within the first sealing system 92.

The second sealing system 94 is also energized or pre-charged via a pressurized gas. As such, the casing spool 82 includes an energizing port 106 configured to supply pressurized gas to the second sealing system 94. Specifically, gas is provided by the gas source 102, pressurized by a pump 108, and supplied to the second sealing system 94 via the energizing port 106. Within the second sealing system 94, the pressurized gas biases or forces seals of the second sealing system 94 against wellhead 12 components (e.g., the casing spool 82, the second seal pack-off assembly 86, and the casing hanger 84) to initially increase seal contact pressure of the seals against the wellhead 12 components. The pressurized gas also expands and/or compresses as wellhead 12 temperatures fluctuate to help maintain seal contact pressure of the second sealing system 94. A plug or check valve 110 disposed at the energizing port 106 may be included to help maintain pressurization of the pressurized gas within the second sealing system 94.

The third sealing system 96 is disposed about the second pack-off assembly 90 between the casing spool 82 and the casing hanger 84. In the illustrated embodiment, the third sealing system 96 includes a mechanical spring (e.g., a Belleville washer) configured to initially energize one or more seals of the third sealing system 96. In other words, the mechanical spring (e.g., annular mechanical spring) provides initial lateral loading on the one or more seals of the third sealing system 96 to initially increase seal contact pressure of the one or more seals against wellhead 12 components sealed by the sealing system 38 (e.g., the casing spool 82, the second seal pack-off assembly 86, and the casing hanger 84). During temperatures fluctuations of the wellhead 12, the mechanical spring may compress and/or expand to maintain seal contact pressure of the seal against the casing spool 82, the second seal pack-off assembly 86, and the casing hanger 84. As the third sealing system 96 is not energized or pre-charged by a pressurized gas, the casing spool 82 does not include an additional energizing port for the third sealing system 96. Additionally, a gas source, pump, plug, and check valve are not used to energize the third sealing system 96.

Although the first and second sealing systems 92 and 94 are illustrated as energized by pressurized gas, other embodiments of the first and second sealing systems 92 and 94 may be energized by mechanical springs, and thus may not include the gas source 102, the pumps 100 and 108, etc. Similarly, while the illustrated third sealing system 96 is energized by a mechanical spring, in other embodiments the third sealing system 96 may be energized by pressurized gas. As such, other embodiments may include additional energizing ports, pumps, plugs, check valves, etc. Indeed, the first, second, and third sealing systems 92, 94, and 96 may be energized by any of the systems described herein or any combination thereof. For example, in certain embodiments, each of the first, second, and/or third sealing systems 92, 94, and/or 96 may be energized by pressurized gas and one or more mechanical springs.

Figure 4:
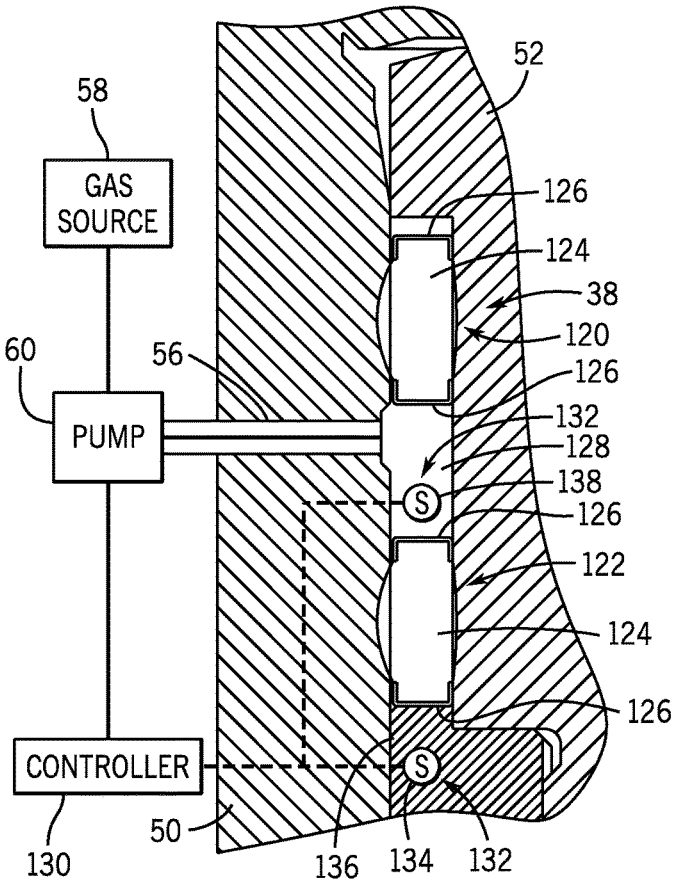
FIG. 4 is a cross-sectional side view of a sealing system, in accordance with embodiments disclosure.

FIG. 4 is a cross-sectional side view, taken within line 4-4 of FIG. 2, illustrating an embodiment of the sealing system 38. The sealing system 38 is energized by a pressurized gas supplied by the gas source 58 and pressurized by the pump 60. The pressurized gas is delivered to the sealing system 38 through the energizing port 56 formed in the tubing spool 50.

The sealing system 38 includes a first seal 120 (e.g., annular seal) and a second seal 122 (e.g., annular seal), each of which are disposed between the tubing spool 50 and the tubing hanger 52. In the illustrated embodiment, the first and second seals 120 and 122 are metal end cap seals. Specifically, each of the first and second seals 120 and 122 includes an elastomer body 124 (e.g., annular body) with end caps 126 (e.g., metal end caps) disposed on axial ends of the respective elastomer body 124. In other embodiments, the first and second seals 120 and 122 may be other types of seals (e.g., annular seals), such as elastomer seals, O-rings, and so forth.

The first and second seals 120 and 122 are axially offset from one another with a gas region 128 (e.g., annular region) disposed therebetween. The gas region 128 is exposed to the energizing port 56 formed in the tubing spool 50. As a result, the pressurized gas from the pump 60 may fill the gas region 128 between the first and second seals 120 and 122. The pressurized gas between the first and second seals 120 and 122 may contact the respective elastomer bodies 124 of each of the first and second seals 120 and 122. More specifically, the pressurized gas may exert pressure (e.g., force) on the elastomer bodies 124 and thereby exert or apply a lateral load on the elastomer bodies 124. In this manner, the seal contact pressure of the elastomer bodies 124 against the tubing spool 50 and tubing hanger 52 may be increased, thereby increasing the sealing contact between the first and second seals 120 and 122, the tubing spool 50 and the tubing hanger 52. The pressurized gas may be supplied to the gas region 128 and the sealing system 38 prior to operation of the wellhead 12. As will be appreciated, increasing the initial seal contact stress of the elastomer bodies 124 of the first and second seals 120 and 122 may reduce the impact on the sealing performance of the first and second seals 120 and 122 caused by fluctuating operating temperatures of the wellhead 12. For example, at lower temperatures when the elastomer bodies 124 may shrink, the pressurized gas within the sealing system 38 may help maintain sealing contact between the first and second seals 120 and 122, the tubing spool 50 and the tubing hanger 52.

In certain embodiments, the pressure of the pressurized gas within the gas region 128 of the sealing system 38 may be adjusted based on a temperature of the wellhead 12 or other operating parameters to help maintain a desired seal contact pressure between the first and second seals 120 and 122, the tubing spool 50 and the tubing hanger 52. For example, the sealing system 38 may include a controller 130 configured to regulate operation of the pump 60 to supply gas (e.g., Nitrogen) to the sealing system 38 at a desired pressure based on feedback from one or more sensors 132. For example, a first sensor 134 may be configured to measure a temperature within an annular region 136 between the tubing spool 50 and tubing hanger 52, and a second sensor 138 may be configured to measure a pressure (e.g., gas pressure) within the gas region 128. In one embodiment, the controller 120 may control operation of the pump 60 to proportionally increase the pressure of the gas supplied to the sealing system 38 as a temperature measured by the first sensor 134 drops.

Figure 5:
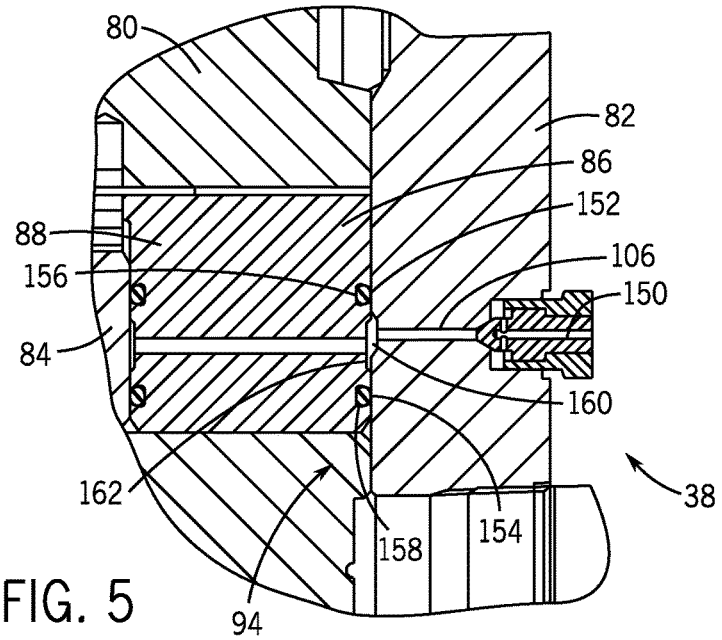
FIG. 5 is a cross-sectional side view of a sealing system, in accordance with embodiments disclosure.

FIG. 5 is a cross-sectional side view, taken within line 5-5 of FIG. 3, illustrating an embodiment of the sealing system 38 (e.g., the second sealing system 94). The sealing system 38 is energized by a pressurized gas supplied by the gas source 58 and pressurized by the pump 60. The pressurized gas is delivered to the sealing system 38 through the energizing port 106 formed in the casing spool 82. As discussed above, the second sealing system 94 is a component of the first seal pack-off assembly 88 disposed between the tubing spool 80, the casing spool 82, and the casing hanger 84. In the illustrated embodiment, the pressurized gas within the second sealing system 88 is retained by a plug 150 sealing the energizing port 106.

The illustrated sealing system 38 includes a first seal 152 (e.g., annular seal) and a second seal 154 (e.g., annular seal), each of which are disposed about the first seal pack-off assembly 88. In particular, the first seal 152 is disposed within a first seal recess 156 (e.g., annular recess) of the first seal pack-off assembly 88, and the second seal 154 is disposed within a second seal recess 158 (e.g., annular recess) of the first seal pack-off assembly 88. In the illustrated embodiment, the first and second seals 152 and 154 are elastomer seals, such as O-rings. The first and second seals 152 and 154 are axially offset about a gas region 160 of the sealing system 38. The gas region 160 is at least partially defined by a recess 162 (e.g., annular recess) formed in the seal-pack off assembly 88. Additionally, the gas region 160 is exposed to the energizing port 106 formed in the casing spool 82. As a result, the pressurized gas from the pump 60 may fill the gas region 160 between the first and second seals 152 and 154. Additionally, the pressurized gas between the first and second seals 152 and 154 may contact the first and second seals 152 and 154 and exert pressure (e.g., force) on the first and second seals 152 and 154. In this manner, the pressurized gas applies a lateral load on the first and second seals 152 and 154, thereby increasing the seal contact pressure of the first and second seals 152 and 154 against the casing spool 82, the casing hanger 84, and the seal pack-off assembly 88. In this manner, the sealing contact between the first and second seals 152 and 154, the casing spool 82, the casing hanger 84, and the seal pack-off assembly 88 may be increased. As similarly discussed above, increasing the initial seal contact stress of the first and second seals 152 and 154 may reduce the impact on the sealing performance of the first and second seals 152 and 154 caused by fluctuating operating temperatures of the wellhead 12.

Figure 6:
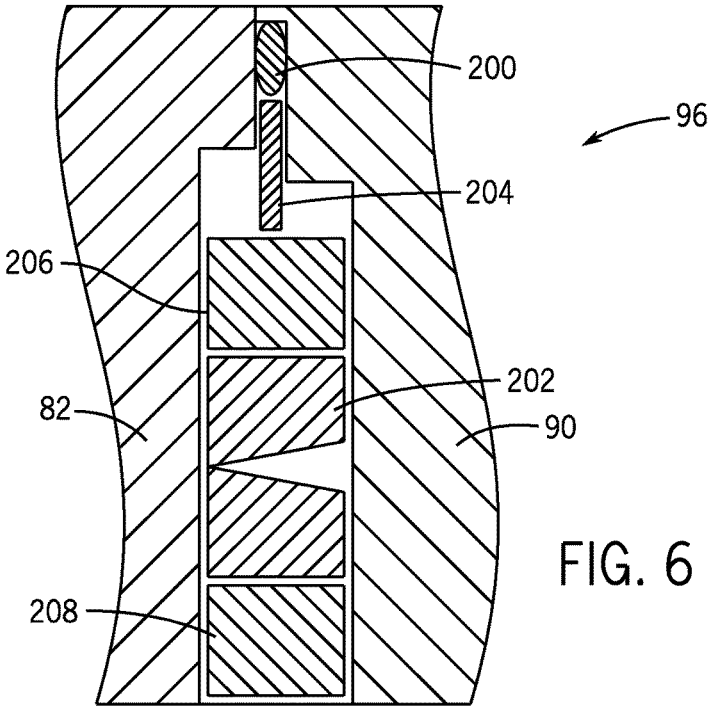
FIG. 6 is a schematic of a sealing system, in accordance with embodiments disclosure.
Figure 7:
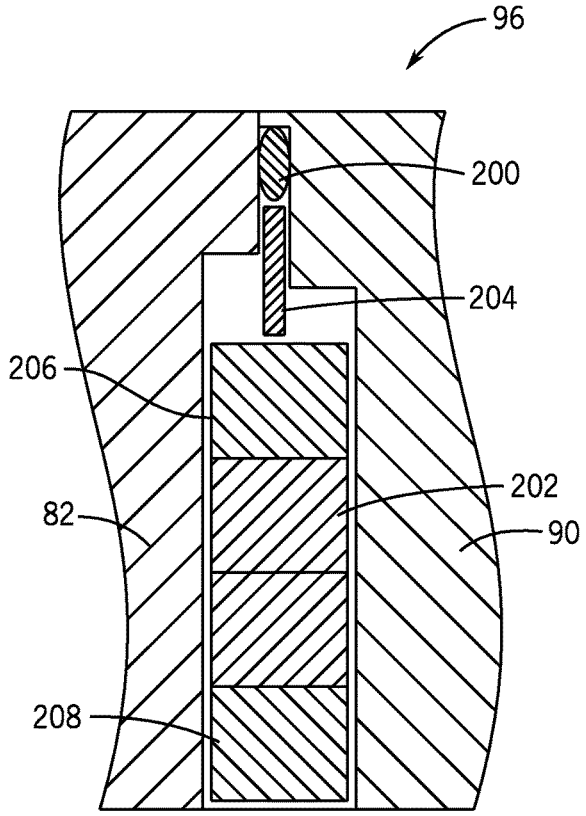
FIG. 7 is a schematic of a sealing system, in accordance with embodiments disclosure.

FIGS. 6 and 7 are cross-sectional side views, taken within line 6-6 of FIG. 3, illustrating an embodiment of the sealing system 38 (e.g., third sealing system 96 disposed about the second seal pack-off assembly 90. The sealing system 38 is energized by a mechanical spring (e.g., Belleville washer). The embodiments illustrated in FIGS. 6 and 7 include a seal 200 (e.g., annular elastomer seal) and a mechanical spring 202 (e.g., Belleville washer). FIG. 6 illustrates the sealing system 38 at a lower temperature, and FIG. 7 illustrates the sealing system at a higher temperature.

As discussed above, the third sealing system 96 is disposed about the second seal pack-off assembly 90 between the casing spool 82 and the casing hanger 84. The third sealing system 96 includes the seal 200 and the mechanical spring 202 (e.g., Belleville washer), along with a first spacer 204 (e.g., annular spacer), a second spacer 206 (e.g., annular spacer), and a third spacer 208 (e.g., annular spacer). The first and second spacers 204 and 206 are disposed axially between the mechanical spring 202 and the seal 200. The third spacer 208 is disposed on an axially opposite side of the mechanical spring 208. In certain embodiments, the third spacer 208 may be axially retained against an axial surface of the casing spool 82, casing hanger 84, or other wellhead 12 component beneath the third sealing system 96.

The mechanical spring 202 may expand and/or contract to help decrease, increase, and/or maintain seal contact pressure of the seal 200 against the second seal pack-off assembly 90, the casing spool 82, and the casing hanger 84. For example, the third sealing system 96 may be installed such that the seal 200 experiences an initial lateral loading to increase an initial seal contact pressure of the seal 200 against the second seal pack-off assembly 90, the casing spool 82, and the casing hanger 84. Additionally, in the manner described below, the mechanical spring 202 may reduce seal contact pressure of the seal 200 at higher temperatures, while maintaining seal contact pressure of the seal 200 at lower temperatures.

As mentioned above, FIG. 6 illustrates the third sealing system 96 at lower temperatures. At lower temperatures, the seal 200, which may be an elastomer seal, may shrink. In such circumstances, a force (e.g., axial force) exerted by the pre-loaded mechanical spring 202 (e.g., Belleville washer) may be transferred to the seal 200 by the first and second spacers 204 and 206. Specifically, the shrinking of the seal 200 may cause the mechanical spring 202 to expand and exert an axial force on the second spacer 206, which may transfer the axial force to the first spacer 204, which may then transfer the axial force to the seal 200. The axial force on the seal 200 may cause the seal to be further pressed against and between the second seal pack-off assembly 90 and the casing spool 82 or casing hanger 84. In this manner, seal contact pressure of the seal 200 may be maintained at lower temperatures.

At higher temperatures, the third sealing system 96 may appear as shown in FIG. 7. As will be appreciated, at higher temperatures, the seal 200 (e.g., elastomer seal) may expand, thereby increasing the seal contact pressure of the seal 200 against and between the second seal pack-off assembly 90 and the casing spool 82 or casing hanger 84. To reduce and/or control the increasing seal contact pressure, the mechanical spring 202 may be compressed. Specifically, as the seal 200 expands, the seal 200 may exert an axial force on the first spacer 204, which may transfer the axial force to the second spacer 206, which may then transfer the axial force to the mechanical spring 202. As shown in FIG. 7, the mechanical spring 202 is compressed from the axial force generated by the seal 200. The transfer of the axial force from the seal 200 to the mechanical spring 202 and the ability of the mechanical spring 202 to absorb the axial force reduces the potential for extrusion of the seal 200 between the second seal pack-off assembly 90, the casing spool 82, and the casing hanger 84. When the higher temperatures drop, the seal 200 may shrink or contract, and the axial force absorbed by the mechanical spring 202 may be transferred back to the seal 200 by the first and second spacers 204 and 206 to help maintain seal contact pressure of the seal 200.

As discussed in detail above, embodiments of the present disclosure include sealing systems 38 that can be installed and energized or "pre-charged" to modify the seal contact pressure of one or more seals (e.g., elastomeric seals) of the sealing system 38. Energizing or pre-charging seals of the sealing system 38 may enable an increase of seal contact pressure of the seals at low temperatures. As will be appreciated, at low temperatures (e.g., below 0° C.), elastomeric seals may shrink and/or lose initial contact stress, which may decrease performance of the sealing system 38. That is, low temperatures may traditionally reduce the sealing capability of elastomeric seals. By energizing or pre-charging the elastomeric seals of the sealing system 38, the initial contact stress (e.g., seal contact pressure) may be increased initially and thereafter maintained when wellhead 12 temperatures fall. As described above, the seals of the sealing system 38 may be energized or pre-charged via loading (e.g., lateral loading) provided by a pressurized gas, mechanical spring 202, or other manner of pressurization.

Additionally, energizing or pre-charging seals of the sealing system 38 may improve performance of the seals (e.g., elastomeric seals) at high temperatures. Specifically, high temperatures, the seals of the sealing system 38 may expand, and the pre-charged sealing system 38 may absorb forces exerted by the expanding seal. For example, in embodiments of the sealing system 38 having the mechanical spring 202, the mechanical spring 202 may compress as the seal expands at high temperatures, thereby reducing extrusion of the seal and controlling the seal contact pressure of the seal. Similarly, in embodiments of the sealing system 38 where the sealing system 38 is pre-charged with a pressurized gas (e.g., a compressible fluid), the gas may compress as the seal expands at high temperatures, thereby also reducing extrusion of the seal and controlling the seal contact pressure of the seal.

While the present disclosure may be susceptible to various modifications and alternative forms, specific embodiments have been shown by way of example in the drawings and have been described in detail herein. However, it should be understood that the present disclosure is not intended to be limited to the particular forms disclosed. Rather, the present disclosure is to cover all modifications, equivalents, and alternatives falling within the spirit and scope of the present disclosure as defined by the following appended claims.

The invention claimed is:

1. A system, comprising:

a first wellhead component;

a second wellhead component; and a sealing system disposed within the first wellhead component and the second wellhead component, wherein the sealing system comprises a first seal, the sealing system is pre-charged with a pressurized gas to increase a first seal contact pressure of the first seal of the sealing system against the first wellhead component and the second wellhead component, and wherein the pressurized gas is contained between the first wellhead component, the second wellhead component, and the sealing system during mineral extraction operation of the system.

2. The system of claim 1, wherein the sealing system comprises a second seal, and the sealing system is pre-charged to increase a second seal contact pressure of the second seal of the sealing system against the first wellhead component and the second wellhead component.

3. The system of claim 2, wherein the first seal comprises a first elastomeric seal, the second seal comprises a second elastomeric seal, and the first and second seals are axially offset about a gas region of the sealing system.

4. The system of claim 3, wherein the pressurized gas is configured to exert a force on the first seal and the second seal to increase the first seal contact pressure and the second seal contact pressure during mineral extraction operation of the system.

5. The system of claim 4, comprising a pump configured to supply the pressurized gas to the gas region through an energizing port, wherein the first wellhead component or the second wellhead component comprises the energizing port.

6. The system of claim 5, comprising a plug configured to seal the energizing port and retain the pressurized gas within the gas region during mineral extraction operation of the system.

7. The system of claim 1, wherein the sealing system comprises a mechanical spring configured to exert an axial force on the first seal.

8. The system of claim 7, wherein the mechanical spring comprises a Belleville washer.

9. The system of claim 1, wherein the first wellhead component comprises a tubing spool and the second wellhead component comprises a tubing hanger.

10. The system of claim 1, wherein the first seal comprises an annular seal disposed about a seal pack-off assembly, the first wellhead component comprises a casing spool, and the second wellhead component comprises a casing hanger.

11. A method, comprising:

disposing a first seal of a sealing system between a first wellhead component and a second wellhead component of a mineral extraction system;

exerting an initial lateral force on the first seal with a pressurized gas to increase a first seal contact pressure of the first seal prior to operation of the mineral extraction system; and containing the pressurized gas between the first seal, the first wellhead component, and the second wellhead component during mineral extraction operation of the mineral extraction system.

12. The method of claim 11, wherein exerting the initial lateral force on the first seal comprises pressurizing a gas region of the sealing system with the pressurized gas, wherein the gas region is axially between the first seal and a second seal of the sealing system.

13. The method of claim 12, comprising plugging an energizing port with a plug to seal the gas region with the pressurized gas, wherein the energizing port is formed in the first wellhead component or the second wellhead component.

14. The method of claim 11, wherein exerting the initial lateral force on the first seal comprises pre-loading a mechanical spring against the first seal, wherein the mechanical spring comprises a Belleville washer.

15. The method of claim 14, comprising compressing the mechanical spring to absorb an expanding force of the first seal during expansion of the first seal at elevated temperatures.

16. A system, comprising:

an annular sealing system configured to be disposed about a first wellhead component, comprising:

a first annular elastomer seal; and a pre-charging system configured to exert a first initial lateral loading force on the first annular elastomer seal to increase a first initial seal contact pressure of the first annular elastomer seal, wherein the pre-charging system comprises a gas source and a pump configured to supply a pressurized gas to a gas region disposed about the first wellhead component, wherein the pressurized gas is configured to exert the first initial lateral loading force, and the pressurized gas is contained within the gas region during mineral extraction operation of the system.

17. The system of claim 16, wherein the annular sealing system comprises a second annular elastomer seal, wherein the pre-charging system configured to exert a second initial lateral loading force on the second annular elastomer seal to increase a second initial seal contact pressure of the second annular elastomer seal.

18. The system of claim 17, wherein the pressurized gas is configured to exert the second initial lateral loading force during mineral extraction operation of the system.

19. The system of claim 16, wherein the pre-charging system comprises a mechanical spring configured to exert the first initial lateral loading force on the first annular elastomer seal, wherein the mechanical spring comprises a Belleville washer.

20. The system of claim 16, comprising the first wellhead component, wherein the first wellhead component comprises a seal pack-off assembly, a tubing hanger, a casing hanger, or any combination thereof.

* * * * *